US005209808A

United States Patent [19]

Booth

[11] Patent Number: 5,209,808

[45] Date of Patent: May 11, 1993

[54] CORNER LABEL APPLICATOR SYSTEM AND METHOD

[75] Inventor: Kenneth N. Booth, Chester, Vt.

[73] Assignee: Imtec, Inc., Bellows Falls, Vt.

[21] Appl. No.: 661,390

[22] Filed: Feb. 26, 1991

[51] Int. Cl.[5] ..... B65C 9/00

[52] U.S. Cl. ..... 156/487; 156/468; 156/480; 156/488; 156/489; 271/11; 271/33; 271/233; 271/234; 271/244; 364/134; 364/156

[58] Field of Search ..... 156/487, 447, 479, 480, 156/488, 489, 468, 476; 364/134, 156, 160.1; 271/33, 11, 244, 234, 733

[56] References Cited

U.S. PATENT DOCUMENTS

| | | | |
|---|---|---|---|
| 1,244,438 | 10/1917 | Southwick | 156/487 |
| 1,274,660 | 10/1918 | Richter | 156/487 |
| 2,217,325 | 10/1940 | Von Hofe | 156/487 |
| 2,277,801 | 3/1942 | Talbot | 156/487 |
| 3,804,694 | 4/1974 | Blair | 156/487 |
| 4,132,583 | 1/1979 | Hodgson | 156/361 |

*Primary Examiner*—David A. Simmons
*Assistant Examiner*—Merrick Dixon
*Attorney, Agent, or Firm*—Stephen G. Matzuk

[57] ABSTRACT

An applicator system and method for automatically applying and securing an adhesive backed (or gummed) label onto a corner surface of a typically three-dimensional, right-angle polygonal object such that the body of the label is applied and adhered to one surface (usually one major surface) of the object and one flap (or usually two) continuous with the body of the label is applied and adhered to a side of the object adjacent the one surface. The applicator system includes an applicator head to receive the adhesive backed label, mechanically secured to an applicator arm which serves to move the applicator head relative to the object. The applicator head includes a backer plate and a tamping mechanism (or tamper plate) connected in spaced relationship through helical (or other) springs to the backer plate, whereby a label applied to the tamping mechanism is applied to the corner surface through spring force of the helical springs which press the label onto the corner surface but are sufficiently resilient to permit movement of the backer plate orthogonal to the tamper plate and, thus, relative to the corner surface. The applicator head includes, typically, two flat, electrically conductive elongated brushed whose longitudinal axes are perpendicular to one another, the plane of the brushes being parallel to one another and to the backer plate, prior to wiping over the flap(s). The applicator head and brushes causes the label body and flap(s) to be thereby pressed onto the corner surface and the sides at the corner surface of the object.

3 Claims, 3 Drawing Sheets

CORNER LABEL APPLICATOR SYSTEM AND METHOD

BACKGROUND OF THE INVENTION

The present invention relates to applicator systems that serve to apply labels or the like to objects, e.g. adhesive backed barcode labels for identification or other purposes.

Attention is called to applications for Letters Patent Ser. No. 07/328,286 filed Mar. 24, 1989, 07/386,214 filed Jul. 28, 1989 and 07/456,494 filed Dec. 26, 1989.

SETTING OF THE INVENTION

A significant industry has been created which permits identification of objects in a many-objects system by applying labels having barcodes and the like to encode each object and to introduce the object-labeled information directly to computers which tabulate, characterize, and so forth, the information. In addition to a part number identification, the information on the label may also include a wealth of other useful data such as date codes, lot size, batch codes, customer I.D., controls, quantity, sales order, etc. Such information is widely used in production processing, and inventory control, and other object related processes.

In many cases the form of the object dictates its physical storage method. For example, sheet material such as paper, or film are usually packaged in a rectangular package that is substantially wider and longer that it is thick. Photographic film, for example, might be packaged in a box that is 8½"w×11" long×½" thick; copier paper wrapped in a similar configuration about 1" thick.

In a production plant, the package and its contents are processed through the plant with the package resting horizontally on its major surface. To achieve automatic processing of some form of machine readable label must be associated with the package. This is most easily done by applying a label to the top of the package.

As soon as the package arrives at a warehouse or customer site, it is stacked onto a shelf of some sort. In many cases, the package and its contents dictate that it be stored flat. For example, copier paper stored on end will not support itself but will curl and wrinkle. Even if the package can be stored on end, in general it will be stored with a narrow end visible to an observer viewing the contents of the shelf. Under these conditions, the label containing all the information that is so useful for machine reading is invisible.

In most product labelling, information is usually preprinted onto the cover of the package such that it appears on one or more edges of the package as well as the top. Where variable data is to be printed as the package is being assembled, such labelling must take place at the time of assembly. If labelling of two or more surfaces is required, such labelling can be accomplished with two or more printers operating in conjunction with two or more applicators.

In general, it is preferable to apply such pre-printed labels automatically. Most applicators of the kind currently available are suitable for applying a label to only one surface at a time.

This multiplicity of equipment is costly. The programming and content of several pieces of equipment is complicated and expensive, not to mention the need to handle multiple label sizes and materials. Furthermore, packages of narrow height and low weight are not readily labeled from the side. Further, also, the automatic labeling of a narrow height package on a face that is oriented perpendicular to the direction of travel along a conveyor is not a trivial task.

OBJECTIVE OF THE INVENTION

Accordingly, it is an objective of the present invention to provide an automatic applicator system that is capable of labeling more than one face of a package in a single operation using a side label. It is a further objective of this invention to label a sufficient number of faces with information printed on the label can be read after labeling both during handling in production and merchandising and after storing on shelves. It is yet a further objective of this invention to provide an applicator system that includes a printer for generating individual labels whose information content is unique to the package being labeled.

SUMMARY OF THE INVENTION

The foregoing objectives are attained, generally, in an applicator system and method for automatically applying and securing an adhesive backed label onto a corner (or other) surface of a typically three-dimensional, right-angle polygonal object such that the body of the label is applied and adhered to one surface (usually one major surface) of the object and one flap (or usually two) contiguous with the body of the label is applied and adhered to a side of the object adjacent (or contiguous) to the one surface. The applicator system includes an applicator head to receive the adhesive backed label. The applicator head is secured to an applicator arm which serves to position the applicator head relative to the object both in transverse directions and toward and away from the object. Wiper mechanism associated with—and in spring-loaded relationship with—the applicator head functions to wipe the flap (or flaps) onto the object.

BRIEF DESCRIPTION OF THE DRAWING

The invention is hereinafter described with reference to the accompanying drawing in which.

DETAILED EXPLANATION OF THE INVENTION

Figure 1:
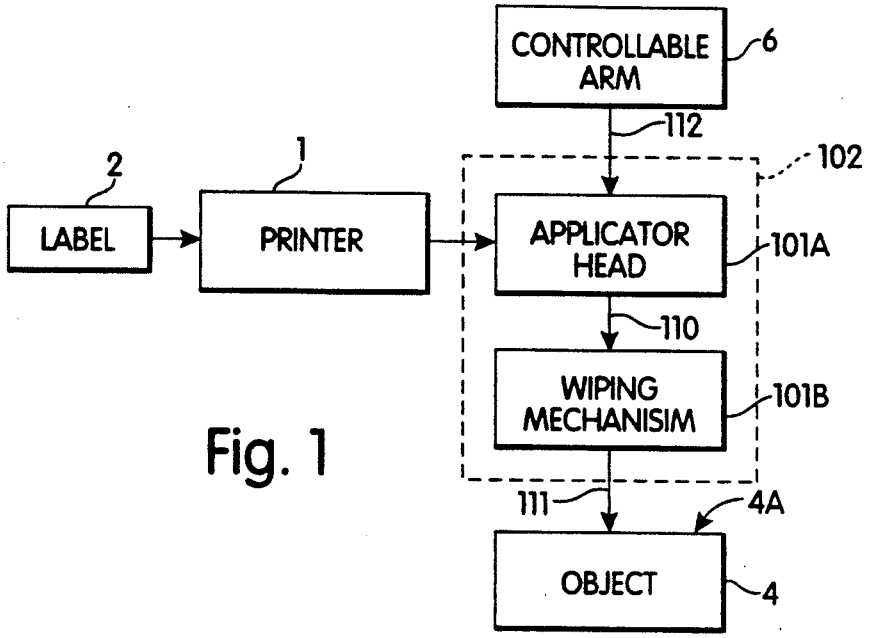
FIG. 1 is a block diagram of an applicator system including structures that embody the present inventive concepts.
Figure 4:
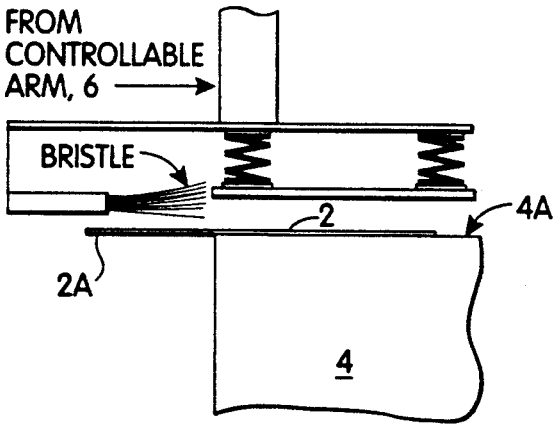
FIGS. 4 and 5 show diagrammatically some structural units shown in earlier figures.
Figure 5:
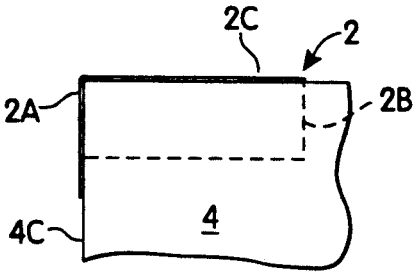
Figure 2A:
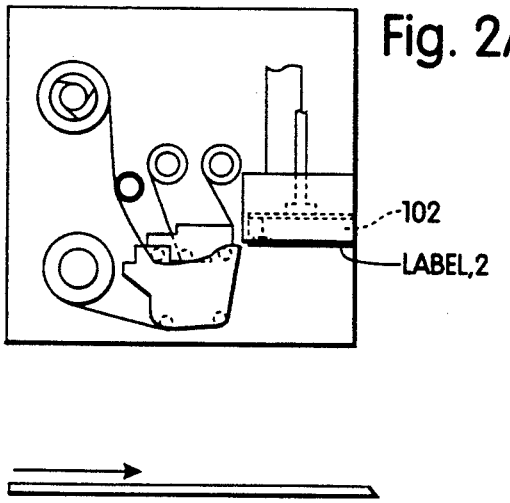
FIGS. 2A . . .
Figure 2D:
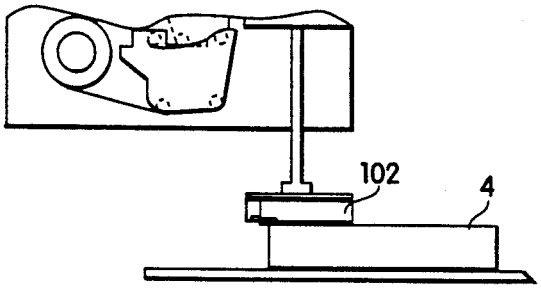
FIG. 2F are diagrammatic representations of portions of the applicator system of FIG. 1 to show, sequentially, operation of some parts shown diagrammatically in the earlier figure.
Figure 2B:
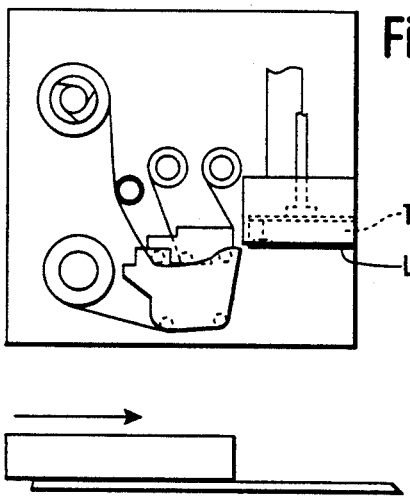
Figure 2E:
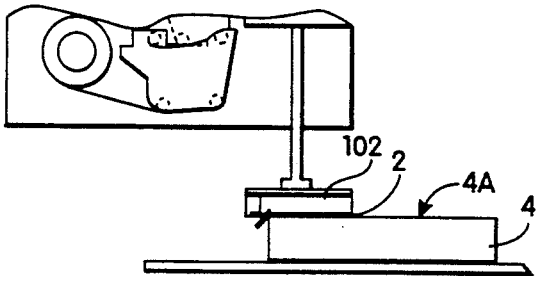
Figure 2C:
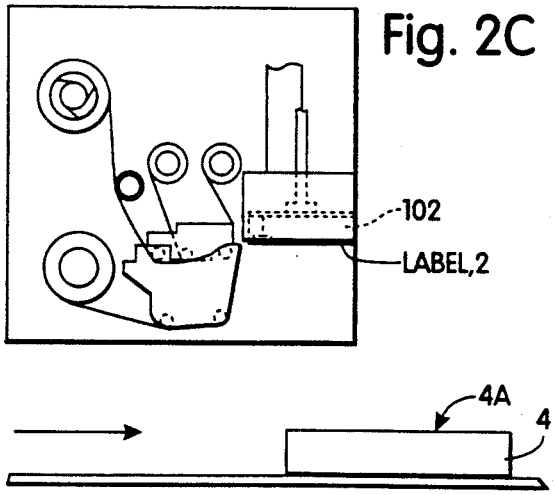
Figure 2F:
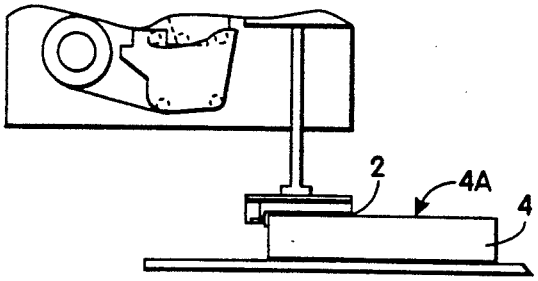

Turning now to FIG. 1, there is shown at 102 an applicator system for applying an adhesive backed label 2 in FIGS. 4 and 5 to an object 4. The applicator system 103 includes a printer 1 positioned to receive a partially pre-printed adhesive backed (gummed) label 2 and operable to apply indicia onto the label 2. Important aspects of the system 103 are included in the block labeled 102 which includes an applicator head 101A and a wiper (or wiping) mechanism 101B. The applicator head 16 is positioned to receive the adhesive backed label 2 and is operable to apply a portion of the label onto a major surface 4A of the object 4. The label 2 has at least one flap 2A in FIGS. 4 and 5—typically there are two or more flaps—that is positioned from the portion of the body of the label to extend beyond the major surface 4A. The wiping mechanism 101 B in FIGS. 1 and 3 includes a brush holder 10 and brushes 10A and 10B whose bristles 10A' and 10B' are electrically conductive to prevent static charge build up. The brushes 10A and 10B are mechanically secured to the brush holder 10 and thence to the back plate 14. The head plate 16 is resiliently connected to the back plate 14 through a comparable connection such as the spring 11, spacer 12 and fasteners 19A and 19B and form a head mechanism 101A. The aforementioned wiping mechanism 101B and head mechanism 101A from a head wiper mechanism 102 which is moved down and up as a unit by respective displacement of the control arm 6 in FIGS. 1 and 3 to move the brush bristles 10A' (and 10B')—which are appropriately positioned (or registered) relative to the object 4—over the at least one flap 2A the brush bristles 10A' are registered over the adhesive backed flap 2A, the brush bristles 10B' are registered over the other flap 2B at an angle normally to the right of flaps 2A and 2B. The brush bristles 10A' press the adhesive backed flap 2A onto the side of the object (or product) 4, as shown in FIGS. 2D and 2F, which side is contiguous to the major surface 4A. The bristles 10B' press further flap 2B onto a contiguous side 4B of the object 4. The applicator head 101A and the wiping mechanism 101B are now taken up.

Figure 3:
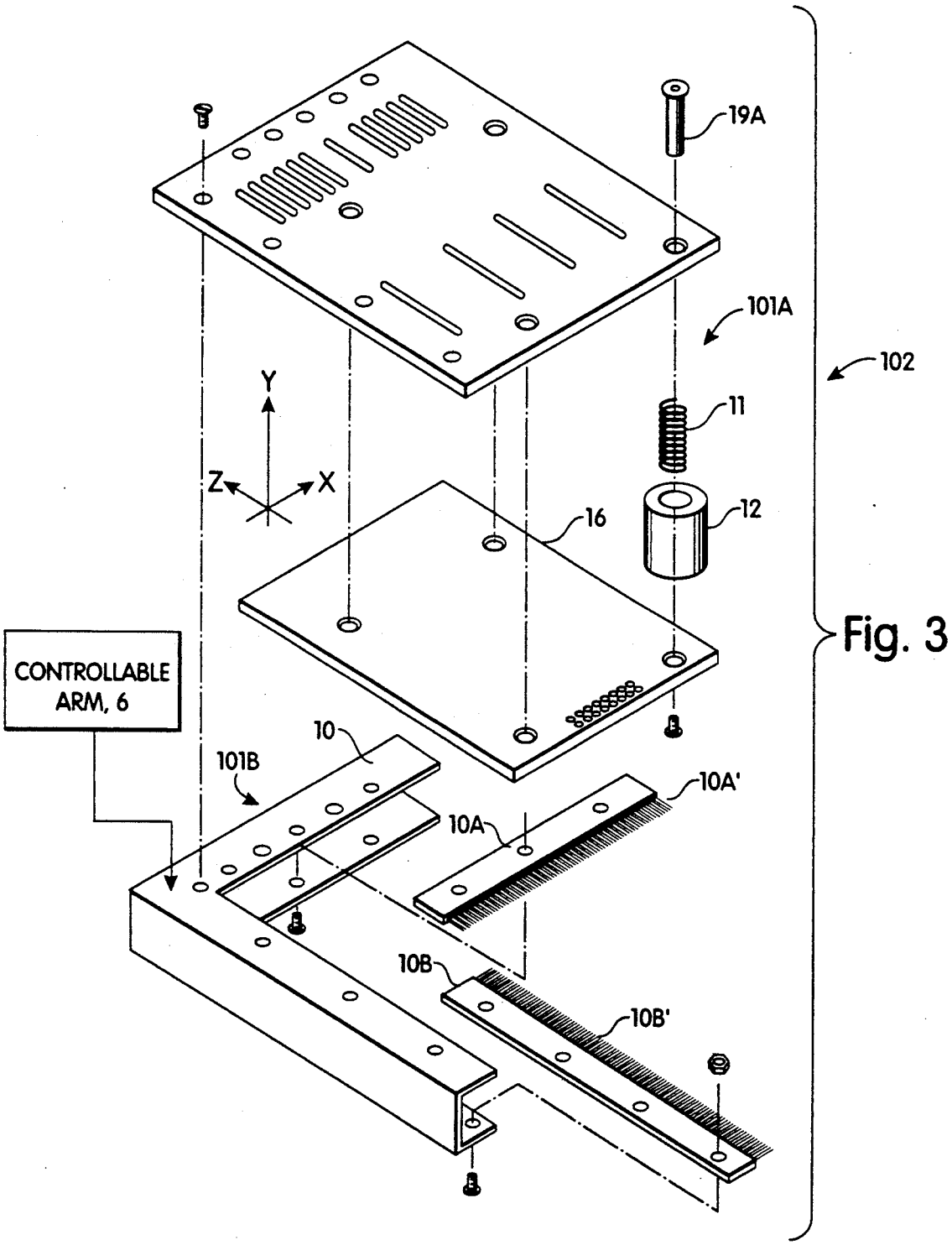
FIG. 3 is an exploded, isometric view showing, in combination, an applicator head and a wiper mechanism in the earlier figure.

A major aspect of this invention is the head/wiper mechanism 102 which is shown in detail in the exploded view of FIG. 3. The head aspect, the applicator head, is again marked 101A in FIG. 3. The tamping wiper plate 16 is attached to a backer plate 14 in FIG. 3 mechanically secured through a spring arrangement 11, 12, 19A, 19B. The backer plate 14 is further mechanically attached (as noted) to the wiping mechanism 101B to cause the applicator head 101A to move in a direction orthogonal to the major surface 4A of the rectilinear object 4 to apply the label 2 thereto and to cause the wiping mechanism 101B to move over the two flaps 2A and 2B, thereby to press the two flaps and adhere the two flaps to sides 4B and 4C of the object 2 in FIG. 5. The explanation continues, mostly with reference to FIG. 3.

There are several, usually four cylinders 12, springs 11, bolts 19B and nuts 19A, which elastically secure the backer plate 14 to the tamping plate 16. The controllable arm 6 in FIG. 1 is connected to apply downward motion onto the backer plate 14 in FIG. 3 the body of a label 2 controls the object 4 and then to continue until sufficient motion to apply pressure exerted by the spring(s) 11 (which may be mechanical springs or hydraulic or air-actuated devices). Under the impact of the arm 6, the backer structure 14 continues downward movement against spring pressure of the spring(s) 11 to press the label 2 onto the major surface 4A; the structure 10 and the brushes 10A and 10B that are integrally and mechanically secured thereto continue to move downward—comprising the spring(s) 11; the conductive bristles 10A' and 10B' move over and press the flaps 2A and 2B onto the sides 4C and 4B, respectively. In this way the label 2 is securely adhered to the object 4. The arm 6, in fact applies a vertical motion, down or up as the case may be, to move the tamping plate 16 (through the mechanism 14) respectively toward and away from the object 4. And as explained, the backer mechanism 14 and the L-shaped brush holder 10 move up and down together, as a rigid body, responsive to the motion of the arm 6.

In accordance with the foregoing, the applicator system 103, under the forces applied by the position-controllable arm 6 (which can be a servomotor, stepping motor, liquid motor or air motor driven) serves to apply the body portion of the label 2 to the one major surface 4A of the object 4 and at least one flap 2A of the label 2 onto at least one side 4C of the object 4, contiguous to the major surface 4A in FIG. 5. The label flap 2B is applied to the contiguous side 4B in FIG. 5.

The object 4 in the figures is typically a polygonal carton having two major surfaces, the upper surface 4A and bottom surface neither shown nor discussed in any detail herein. The object 4 also, typically, has four sides 4C . . . . The body portion 2C of the label 2 is adhered to the one major surface 4A, and the adhesive backed flap 2A is adhered to one of the four sides (the side 4C). The applicator, accordingly, includes the tamping plate 16 that serves to press the body portion 2C of the label 2 onto the major surface 4A and a brush 10A that wipes the flap 2A onto the side 4C.

As is indicated above, the usual applicator system 103 applies the adhesive label 2 to a polygonal, rectilinear object 4 which has major upper surface 4A, a lower surface and four minor surfaces 4C . . . contiguous to the major surfaces. The label 2 includes the body portion 2C and the flaps 2A . . . integral with the body portion 2C. The adjoining surfaces 4A, 4B, 4C . . . of the object 4 are orthogonal to one another. The wiping mechanism 101B includes the two elongate brushes 10A and 10B (whose bristles 10A' and 10B' are electrically conductive, with the elongate for longitudinal dimension (i.e., plus/minus x-direction in FIG. 3) of one brush (e.g., 10A) disposed substantially orthogonal to the like dimension (i.e., z-direction in FIG. 3) of the other brush (e.g. 10B), the plane of each brush (i.e., the x-z plane in FIG. 3), including the bristle thereof between wipes, being disposed essentially parallel to the major surfaces 4A . . . . The label 2 includes the body portion 2C and at least one flap 2A integral with the body portion 2C.

The tamping plate 16 of the head 102 in FIGS. 3 and 2A–2F receives the body portion of the label. The backer mechanism 14 is mechanically secured through the spring mechanisms 11, 12 . . . to the tamping plate 16. In FIG. 3 the L-shaped holder 10 is shown to interconnect the backer mechanism 14 (which interconnected through the springs 11 . . . to the tamping plate 16) to the brushes 10A and 10B which, accordingly move vertically (in the Y-direction) by virtue of vertical motion exerted on the L-shaped holder 10 by the controllable arm (which can be hydraulically driven, for example). Also, in the present system the movement of the L-shaped holder 10 (and parts mechanically attached thereto) is vertical; but such movement can be transverse, as well. In this way a label 2 is loaded onto the tamping plate 16 which is then moved vertically downward in FIGS. 2A–2F to apply the label onto the upper surface of the object 4. At that juncture springs (or other position-restoring mechanisms) increase the force, pressing the label 2 onto the surface 4C of the product 4 while nevertheless permitting downward (minus-Y) translational movement of the brushes 10A and 10B past and over the flaps 2A and 2B, whereby the flaps 2A and 2B are wiped onto sides of the object 4.

According to the present teaching, the adhesive backed label 2 is printed at 1 in FIG. 1. It is applied to an applicator head 101A which presses it onto the object 4. The applicator head 101A and the wiping mechanism 101B in accordance with the present teaching really act as a unit 102. The applicator head receives the printed label 2; it presses label 2 onto the upper major surface 4A of the object 4 against the forces of the spring(s) 11. The controllable arm 6 moves sufficiently downward to apply the foregoing downward forces in FIGS. 1 and 3 and to continues this downward motion so as to move the brushes 10A and 10B in wiping action across and over the flaps 2A and 2B in FIG. 5 to press these flaps onto sides of the object 4.

Modifications of the invention herein disclosed including the labelling of more than 2 sides, e.g. 3 or 4 sides of a rectilinear box or polygons of 3 or more sides that are not rectilinear will occur to persons skilled in the art and all such modifications are deemed to be within the scope of the invention as defined by the appended claims.

What is claimed is:

1. For use in an application system for applying an adhesive label having a central body and two outward extending flaps to a polygonal rectilinear object, that object having two major surfaces and four minor surfaces contiguous to the two major surfaces thereof, wherein adjoining surfaces of the object are orthogonal to one another;

a wiping mechanism comprising two elongated brushes whose bristles are electrically conductive disposed with the elongate (or longitudinal) dimension of each brush disposed substantially orthogonal to the like dimension of the other brush, the place of each brush, including the bristles thereof, between wipes, being disposed essentially parallel to said two major surfaces, and an applicator head to receive the adhesive label, said applicator head including a tamping plate mechanically secured through compressive spring means to a backing structure and further mechanically attached to the wiping mechanism to cause the tamping structure to move in a direction orthogonal to a major surface of the polygonal rectilinear object to apply the label there and to cause the wiping mechanism to move over the two flaps of the label to press the same onto the said major surface and adhere the said two flaps to the said minor surface of the object.

2. For use in an applicator system that includes a position-controllable arm, which system serves to apply the body portion of a adhesive backed label to one surface of an object and at least one flap of the label onto at least one side of the object contiguous to said one surface, an applicator head comprising;

a backer structure or mechanism;

a tamping mechanism mechanically secured by spring means to the backer structure or mechanism; and a wiping mechanism mechanically secured to the backer structure or mechanism spaced from the backer structure or mechanism, the arm being operable to move the backer structure, and hence the tamping mechanism and the wiping mechanism secured thereto, toward and away from the object respectively to attach the body portion of the adhesive backed label to said surface, then at least one flap onto at least one side of said object and to retract the backer structure or mechanism, said tamping mechanism serving to press the body portion of the label onto the object and then being sufficiently resilient to permit the wiping mechanism to continue its action against compressing pressure by virtue of force exerted by the arm, to effect movement of the wiping mechanism to achieve wiping of the at least one flap onto the object.

3. A applicator head according to claim 2 in which the wiping mechanism comprises two elongate brushes whose bristles are electrically conductive connected to the backer structure or mechanism, the longitudinal axis, that is, the axis perpendicular to the bristle axis, of each brush being disposed orthogonal to the longitudinal axis of the other brush, one end of each brush being in close proximity to the corresponding end of the other brush to achieve wiping at a corner of the object.

* * * * *